US007367311B2

(12) United States Patent
Norimoto et al.

(10) Patent No.: US 7,367,311 B2
(45) Date of Patent: May 6, 2008

(54) CONTROL SYSTEM FOR COMPRESSION IGNITION INTERNAL COMBUSTION ENGINE

(75) Inventors: Sumiko Norimoto, Kobe (JP); Akikazu Kojima, Gamagori (JP); Hiroshi Haraguchi, Kariya (JP)

(73) Assignee: Denso Corporation, Kariya, Aichi-pref (JP)

( * ) Notice: Subject to any disclaimer, the term of this patent is extended or adjusted under 35 U.S.C. 154(b) by 0 days.

(21) Appl. No.: 11/698,063

(22) Filed: Jan. 26, 2007

(65) Prior Publication Data

US 2007/0175445 A1 Aug. 2, 2007

(30) Foreign Application Priority Data

Jan. 30, 2006 (JP) ..... 2006-020220

(51) Int. Cl.
*F02P 5/00* (2006.01)

(52) U.S. Cl. ..... 123/295; 123/406.44

(58) Field of Classification Search ..... 123/295, 123/406.23, 406.44
See application file for complete search history.

(56) References Cited

U.S. PATENT DOCUMENTS 5,577,476 A * 11/1996 Iyoda ..... 123/406.33
6,325,046 B1 * 12/2001 Kanno ..... 123/406.44
6,481,416 B2 * 11/2002 Palazzi et al. ..... 123/406.23
2005/0022517 A1 2/2005 Miura

* cited by examiner

*Primary Examiner*—Erick Solis
(74) *Attorney, Agent, or Firm*—Nixon & Vanderhye P.C.

(57) ABSTRACT

A compression ignition internal combustion engine includes injectors, each of which injects fuel into a corresponding cylinder. An ECU determines target ignition timing based on engine operational information and adjusts fuel injection start timing and a fuel injection quantity of each injector based on the target ignition timing. The engine further includes an air/fuel ratio sensor, which senses an oxygen concentration of exhaust gas. The ECU corrects the target ignition timing based on the oxygen concentration, which is sensed with the air/fuel ratio sensor, with reference to a predefined relationship between the oxygen concentration and ignition timing for achieving a generally equal constant torque of the engine.

6 Claims, 5 Drawing Sheets

CONTROL SYSTEM FOR COMPRESSION IGNITION INTERNAL COMBUSTION ENGINE

CROSS REFERENCE TO RELATED APPLICATION

This application is based on and incorporates herein by reference Japanese Patent Application No. 2006-20220 filed on Jan. 30, 2006.

BACKGROUND OF THE INVENTION

1. Field of the Invention

The present invention relates to a control system for a compression ignition internal combustion engine.

2. Description of Related Art

For example, some compression ignition internal combustion engines, such as diesel engines, have direct fuel injection valves that inject fuel into corresponding cylinders. The fuel, which is injected from each fuel injection valve into the corresponding cylinder, is combusted together with intake air. In the above type of internal combustion engine, there are implemented multiple combustion modes, which have different fuel injection timings that are set in view of the engine output characteristics and exhaust gas characteristics. One of the fuel combustion modes is selected based on the rotational speed and the load of the engine. The fuel injection timing, the fuel injection quantity, the intake air quantity and the recirculation quantity of the exhaust gas through an exhaust gas recirculation system are controlled for each combustion mode. For example, in the conventional combustion, a premixed combustion period and a diffusion combustion period exist. In the premixed combustion period, the fuel and the air are mixed together during an ignition delay period, and then the premixed combustion of this air-fuel mixture takes place. In the diffusion combustion period, the injected fuel is immediately combusted right after the fuel injection. In contrast to the conventional combustion, in a lately developed premixed combustion, the control operation is performed such that the oxygen concentration is set to be a relatively low value due to supply of a large quantity of the EGR gas, and the ignition timing does not occur in the fuel injection period. In the following description, this widely known premixed combustion will be referred to as complete premixed combustion. Besides the complete premixed combustion, a semi-premixed combustion may be implemented in an intermediate range in an engine operational range between the complete premixed combustion and the conventional combustion, as shown in FIG. 2, to achieve smooth change between the complete premixed combustion and the conventional combustion. In the semi-premixed combustion, each of the oxygen concentration, the fuel injection timing and the fuel injection quantity are set to be a corresponding intermediate value between the corresponding value in the complete premixed combustion and the corresponding value in the conventional combustion.

During the operation of the engine, a change in the fuel injection system and a change in the air system show different responses relative to a change in its corresponding target. Specifically, this is due to the following differences between the fuel injection system and the air system. That is, in the fuel injection system, the fuel injection timing and the fuel injection quantity may be instantaneously adjusted by changing the fuel injection mode. In contrast, in the air system, an actuation delay of an actuator(s) and a delay in conduction of a flow may occur. Because of this, the balance between the fuel injection system and the air system is deteriorated at the time of changing the combustion mode, so that the characteristics of the exhaust gas may be deteriorated, and the shaft torque may be changed. This may cause a deterioration of the drivability of the vehicle.

Japanese Unexamined Patent Publication Number 2005-48724 (corresponding to US 2005/0022517 A1) discloses a control method that addresses the above disadvantage. According to this control method, when a target value of an excess air ratio significantly changes, a ratio between an amount of change in the target value of the excess air ratio and a difference between the target value of the excess air ratio and an actual value of the excess air ratio is obtained. Based on this ratio, the fuel injection timing is corrected. FIG. 6A shows a way of correcting the fuel injection timing by applying the above control method in a case where the target value of the excess air ratio is changed at the timing ta. In FIG. 6A, the amount of change in the target value of the excess air ratio will be denoted by A1, and the amount of change in the target value of the fuel injection timing is denoted by B1. Furthermore, a difference between the target value of the excess air ratio and the actual value of the excess air ratio is denoted by A2, and a difference between the target value of the fuel injection timing and the actual value of the fuel injecting timing is denoted by B2. The fuel injection timing is corrected in a manner that satisfies a relationship of A1:A2=B1:B2.

The inventors of the present invention found a relationship between the excess air ratio (corresponding to oxygen information) and the fuel injection timing (corresponding to ignition timing) for achieving the generally equal constant shaft torque of the engine. FIG. 6B shows the relationship between the excess air ratio and the fuel injection timing for achieving the generally equal constant shaft torque where the control method disclosed in Japanese Unexamined Patent Publication Number 2005-48724 is applied.

In FIG. 6B, a characteristic curve L3 indicates the relationship between the excess air ratio and the fuel injection timing for achieving the generally equal constant shaft torque before changing of the combustion mode from the conventional combustion to the complete premixed combustion, and a characteristic curve L4 indicates the relationship between the excess air ratio and the fuel injection timing for achieving the generally equal constant shaft torque after the changing of the combustion mode from the conventional combustion to the complete premixed combustion. As discussed above, the EGR quantity in the complete premixed combustion is larger than the EGR quantity in the conventional combustion, so that the characteristic curves L3, L4 differ from one another. The target value of the excess air ratio and the target value of the injection timing are located at a point D of the characteristic curve L3 before the timing ta, at which the combustion mode is changed from the conventional combustion to the complete premixed combustion. However, after the timing ta, the target value of the excess air ratio and the target value of the injection timing are located at a point E of the characteristic curve L4. As discussed above, the change in the air system is delayed from the change in the fuel injection system, so that the fuel injection timing is corrected to satisfy the relationship of the A1:A2=B1:B2. Thus, the excess air ratio and the fuel injection timing at the arbitrary timing tb are located at a point F, which is deviated from the characteristic curve L4 in the combustion mode after the changing from the conventional combustion to the complete premixed combustion. Therefore, the combustion is changed to have the different shaft torque that is different from the shaft torque before the changing of the combustion mode. As a result, the drivability of the vehicle is deteriorated.

SUMMARY OF THE INVENTION

The present invention addresses the above disadvantage. Thus, it is an objective of the present invention to provide a control system for a compression ignition internal combustion engine, capable of limiting deterioration in a fuel combustion state, which would be caused by a delayed change in an air system, to maintain a good drivability of a vehicle.

To achieve the objective of the present invention, there is provided a control system for a compression ignition internal combustion engine that has a fuel injection valve, which injects fuel into a corresponding cylinder of the engine. The control system includes a control means, an oxygen information obtaining means and a correcting means. The control means is for determining target ignition timing based on operational information of the engine and is for adjusting a fuel injection mode at the fuel injection valve according to the target ignition timing. The oxygen information obtaining means is for obtaining oxygen information of exhaust gas, which is exhausted from the cylinder of the engine. The correcting means is for correcting the target ignition timing based on the oxygen information, which is obtained by the oxygen information obtaining means, with reference to predefined constant torque characteristic data, which indicates a relationship between the oxygen information and ignition timing to achieve a generally equal constant torque.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the present invention will be described with reference to the accompanying drawings. In the present embodiment, an engine control system is constructed for a four cylinder diesel engine, which serves as a vehicle engine. In the control system, an electronic control unit (ECU) plays a central role in a fuel injection control operation. First, an entire structure of an engine control system will be schematically described with reference to FIG. 1.

Figure 1:
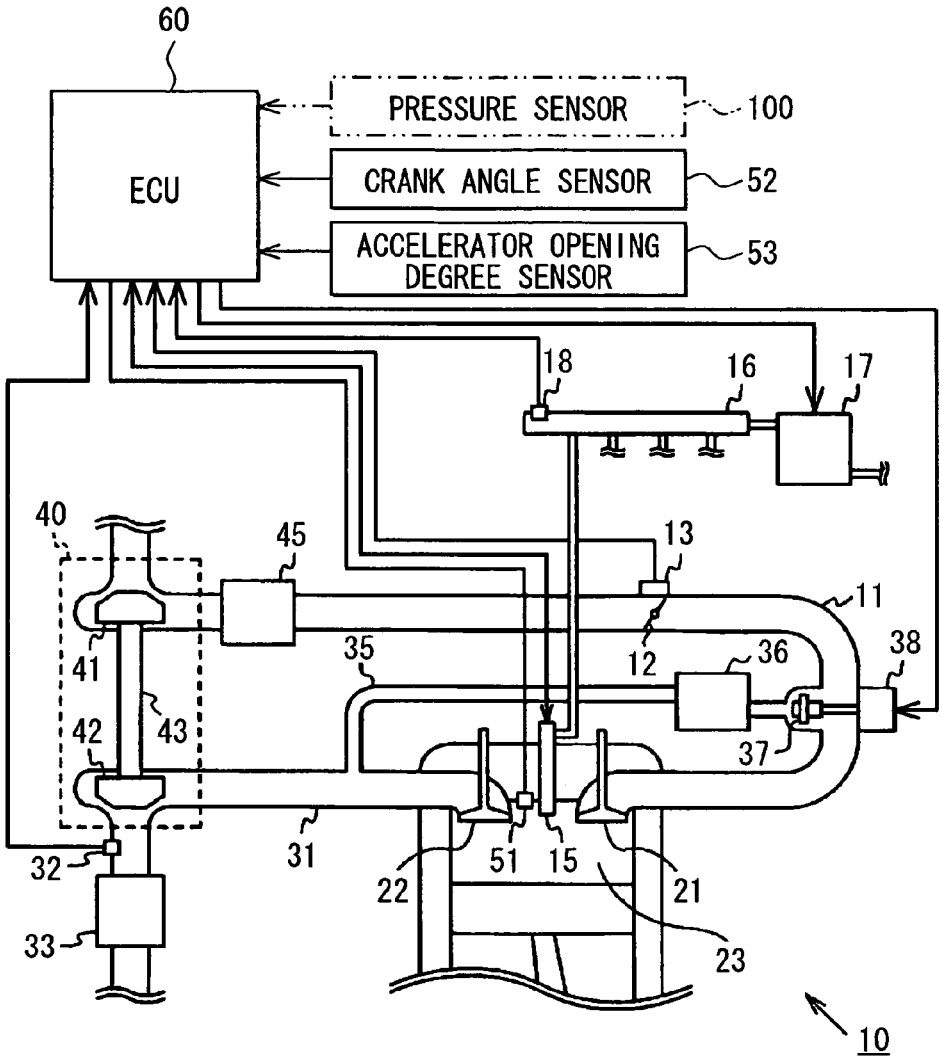
FIG. 1 is a diagram showing an entire structure of an engine control system according to an embodiment of the present invention.

In the engine 10 shown in FIG. 1, a throttle valve 12 is provided in an intake air pipe 11. The throttle valve 12 is driven by a throttle actuator 13, which includes a DC motor, so that an opening degree of the throttle valve 12 is adjusted. The intake air pipe 11 is branched on a downstream side of the throttle valve 12 and is connected to respective intake ports of cylinders of the engine 10.

In the engine 10, injectors (fuel injection valves) 15 are provided to the cylinders, respectively. The injectors 15 are connected to a common rail 16, which is in turn connected to a high pressure pump 17. When the high pressure pump 17 is driven, the high pressure pump 17 takes fuel from a fuel tank (not shown) and pumps the fuel to the common rail 16. Thus, the common rail 16 continuously accumulates the high pressure fuel. The common rail 16 has a common rail pressure sensor 18, which senses a fuel pressure (a common rail pressure) inside the common rail 16.

An intake valve 21 and an exhaust valve 22 are provided to an intake port and an exhaust port of each cylinder of the engine 10. Air is supplied into a combustion chamber 23 of each cylinder upon opening of the corresponding intake valve 21 and is combusted along with the fuel injected from the corresponding injector 15 into the combustion chamber 23. Exhaust gas, which is generated at the time of the combustion, is exhausted through an exhaust pipe 31 upon opening of the exhaust valve 22. An air/fuel ratio sensor 32 and a diesel particulate filter (hereinafter referred to as a DPF) 33 are provided at a downstream part of the exhaust pipe 31.

The engine 10 includes an exhaust gas recirculation system (EGR system), which recirculates a portion of the exhaust gas into the intake system as EGR gas. An EGR pipe 35 is provided between a portion of the intake air pipe 11, which is on the downstream side of the throttle valve 12, and the exhaust pipe 31. An EGR cooler 36 is provided in the EGR pipe 35 to cool the EGR gas, which is recirculated into the EGR pipe 35. Furthermore, an EGR valve 37 is provided at a connection between the EGR pipe 35 and the intake air pipe 11 to adjust a recirculation quantity of the EGR gas. The EGR valve 37 is opened and closed by an EGR actuator 38. When the EGR gas is recirculated into the intake system, the combustion temperature is decreased to limit generation of NOx.

Furthermore, a turbocharger 40 is provided between the intake air pipe 11 and the exhaust pipe 31. The turbocharger 40 includes a compressor impeller 41 and a turbine wheel 42, which are interconnected by a rotatable shaft 43. The compressor impeller 41 is provided in the intake air pipe 11. The turbine wheel 42 is provided in the exhaust pipe 31. In the turbocharger 40, the turbine wheel 42 is rotated by the exhaust gas that flows in the exhaust pipe 31, and the rotational force of the turbine wheel 42 is conducted to the compressor impellor 41 through the rotatable shaft 43. The compressor impellor 41 is rotated by the transmitted rotational force to compress the intake air that flows in the intake air pipe 11 and thereby to supercharge the air. The supercharged air, which is supplied from the turbocharger 40, is cooled by an intercooler 45 and is supplied to the downstream part of the intake air pipe 11. The intake air is compressed by the turbocharger 40, so that the charging efficiency of the intake air is increased.

A combustion pressure sensor 51, which senses a cylinder pressure, is provided in the engine 10. Furthermore, a crank angle sensor 52 and an accelerator opening degree sensor 53 are provided in the engine control system. The crank angle sensor 52 outputs a crank angle signal in a form of a rectangular wave at every predetermined crank angle (e.g., 30° CA cycle). The accelerator opening degree sensor 53 senses an accelerator operational amount (an accelerator opening degree), which is an operational amount of an accelerator by a driver.

The ECU 60 includes a conventional microcomputer as its main component. The microcomputer has a CPU, a ROM and a RAM. When control programs stored in the ROM are executed, various control operations of the engine 10, such as the fuel injection control operation, are performed according to the engine operational state. The ECU 60 receives the measurement signals from, for example, the common rail pressure sensor 18, the combustion pressure sensor 51, the crank angle sensor 52 and the accelerator opening degree sensor 53 as the operational information, which indicates the current engine operational state.

The ECU 60 obtains ignition timing based on the measurement signal from the combustion pressure sensor 51. Specifically, the ECU 60 obtains a cylinder volume, which changes along with the time according to the slide movement of the piston, based on the measurement signal from the crank angle sensor 52. Then, the ECU 60 computes a rate of heat generation based on the obtained cylinder volume and the cylinder pressure that is obtained from the combustion pressure sensor 51. Then, the ECU 60 sets timing, at which the rate of heat generation exceeds a predetermined reference value, as the ignition timing.

In the engine 10, which is controlled by the present control system, three combustion modes, i.e., "the conventional combustion", "the complete premixed combustion" and "the semi-premixed combustion" exist. Besides the ignition control operation through controlling of the EGR quantity, in the conventional combustion, which is a first combustion mode, fuel is injected from the injector 15 into the cylinder that is in the highly compressed state. At that time, due to the highly compressed state, the fuel is ignited and is combusted right after the fuel injection. In the complete premixed combustion, which is a second combustion mode, the fuel is injected from the injector 15 into the cylinder in the earlier timing, which is earlier than that of the conventional combustion, i.e., in the intake stroke or the beginning of the compression stroke. At that time, the cylinder pressure is relatively low, so that the fuel, which is injected from the injector 15, is not immediately ignited. That is, the fuel, which is injected from the injector 15, is well mixed with the intake air in the cylinder until the cylinder is placed in the highly compressed state. Then, when the cylinder is placed in the highly compressed state, the fuel is ignited and is combusted. In the semi-premixed combustion, which is a third combustion mode, the fuel is injected from the injector 15 at the intermediate timing, which is earlier than that of the conventional combustion (the first combustion mode) and is later than that of the complete premixed combustion (the second combustion mode). At that time, the cylinder pressure is relatively low, so that the fuel, which is injected from the injector 15, is not immediately ignited. That is, the fuel, which is injected from the injector 15, is mixed with the intake air to some degree in the cylinder until the cylinder is placed in the highly compressed state. Then, when the cylinder is placed in the highly compressed state, the fuel is ignited and is combusted.

The premixed combustion is not limited to this mode. For example, as described above, the fuel may be injected from the injector 15 at the corresponding timing, which is adjacent to the top dead center, and the ignition timing may be delayed to promote the mixing of the fuel and the air by supplying the large quantity of the EGR gas through the opening/closing operation of the EGR valve 37. Particularly, in the complete premixed combustion, the quantity of the EGR gas (EGR gas quantity) is controlled in a manner that does not cause ignition of the fuel in the middle of the fuel injection. In the semi-premixed combustion, the combustion is intermediate between the complete premixed combustion and the normal premixed combustion. That is, in the semi-premixed combustion, the EGR gas quantity is controlled in such a manner that the ignition occurs in the late stage of the fuel injection.

Figure 2:
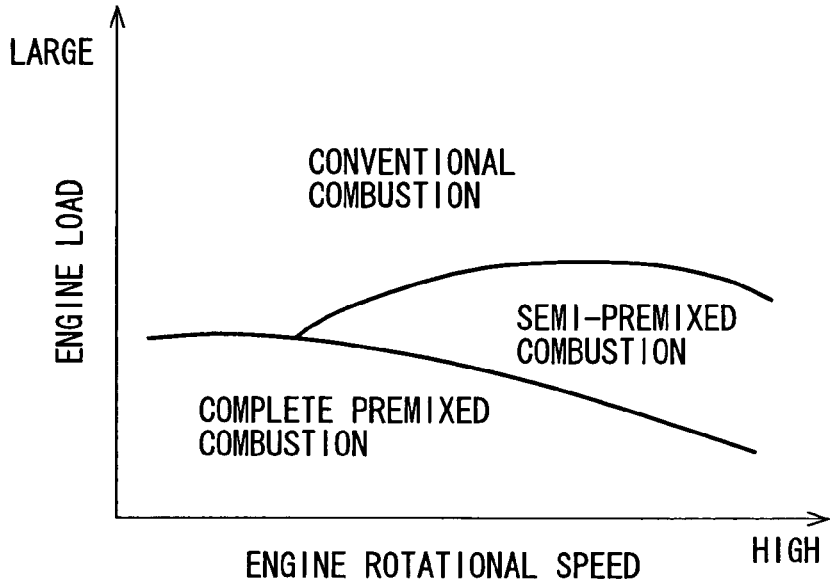
FIG. 2 is a diagram showing combustion modes with reference to an engine operational range.

FIG. 2 is the diagram, which shows the above combustion modes of the engine 10 in view of the operational range of the engine 10. The ECU 60 changes the combustion mode of the engine 10 according to the engine operational range, which is defined by the engine rotational speed and the engine load. In the low rotational speed range or the low load range of the engine 10, the complete premixed combustion (the second combustion mode) is performed. In contrast, in the high rotational speed range or the high load range of the engine 10, the conventional combustion (the first combustion mode) is performed. Furthermore, in the intermediate rotational speed range of the engine 10, which is between the low rotational speed range and the high rotational speed range, or the intermediate load range, which is between the low load range and the high load range, the semi-premixed combustion (the third combustion mode) is performed.

At the time of changing the combustion mode, the target value of the ignition timing, the target value of the intake air quantity and the target value of the EGR gas quantity change. The ignition timing can be instantaneously adjusted by changing the injection parameters, such as the fuel injection start timing and the fuel injection quantity at the injector 15. However, the intake air quantity and the EGR gas quantity cannot be instantaneously adjusted due to, for example, the actuation delay of the throttle actuator 13, the actuation delay of the EGR actuator 38 and the delay in the conduction of the gas flow. Thus, the balance between the ignition timing and the intake air quantity as well as the EGR gas quantity is deteriorated to deteriorate the combustion state, so that the shaft torque is disadvantageously changed.

The inventors of the present invention found that there exists the best ignition timing, which corresponds to the exhaust gas oxygen concentration to implement the combustion state, at which the shaft torque is placed at the generally equal constant value. Specifically, when the exhaust gas oxygen concentration is relatively low, the ignition timing is relatively advanced. When the exhaust gas oxygen concentration is increased, the ignition timing is retarded. Although the oxygen concentration in the exhaust gas doe not have the direct influence on the combustion, the correlation between the oxygen concentration of the intake gas and the oxygen concentration of the exhaust gas exists. Therefore, the exhaust gas oxygen concentration can be used to monitor the oxygen concentration of the intake gas. Furthermore, the relationship between the exhaust gas oxygen concentration and the ignition timing varies depending on the combustion mode and the engine operational state. Thus, according to the present embodiment, at the time of changing the combustion mode from one to another, the target ignition timing is corrected based on the measured exhaust gas oxygen concentration, which is measured with the air/fuel ratio sensor 32.

Figure 3:
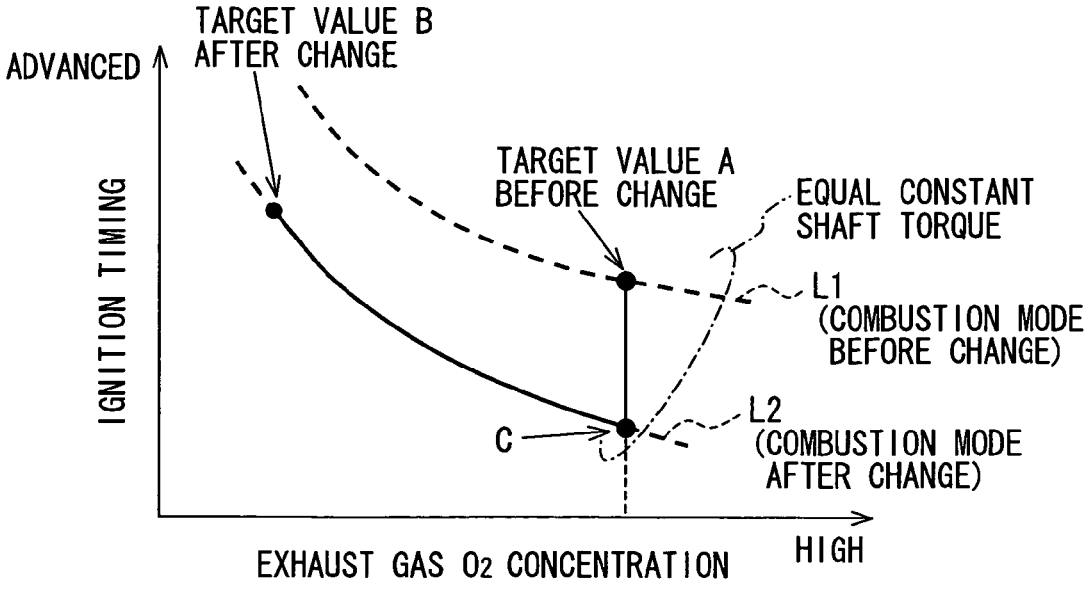
FIG. 3 is a diagram showing a relationship between an exhaust gas oxygen concentration and ignition timing for achieving a generally equal constant shaft torque according to the embodiment.

FIG. 3 is the diagram that shows the relationship between the exhaust gas oxygen ($O_2$) concentration and the ignition timing for achieving the generally equal constant shaft torque. In FIG. 3, the relation ship between the exhaust gas oxygen concentration and the ignition timing for achieving the generally equal constant shaft torque under the same engine operational state is indicated by a characteristic curve L1 and a characteristic curve L2. The characteristic curves L1, L2 correspond to constant torque characteristic data of the present invention. Here, the characteristic curve before the changing of the combustion mode is the characteristic curve L1, and the characteristic curve after the changing of the combustion mode is the characteristic curve L2. As discussed above, the characteristic curves L1, L2 should be set in such a manner that the ignition timing is delayed when the exhaust gas oxygen concentration is increased to implement the generally equal (same) torque before and after the changing of the combustion mode.

Now, a correction method for correcting the target ignition timing to shift the combustion state from a point A to a point B at the time of changing the combustion mode will be described. The exhaust gas oxygen concentration is not substantially changed right after the changing of the combustion mode due to the delayed change in the air system. In view of this, the ignition timing is changed from the point A to a point C to shift the combustion state to the point C of the characteristic curve L2. Thereafter, as the exhaust gas oxygen concentration changes due to the change in the air system, the target ignition timing is corrected from the point C to the point B on the characteristic curve L2 to shift the combustion state to the point B.

Figure 4A:
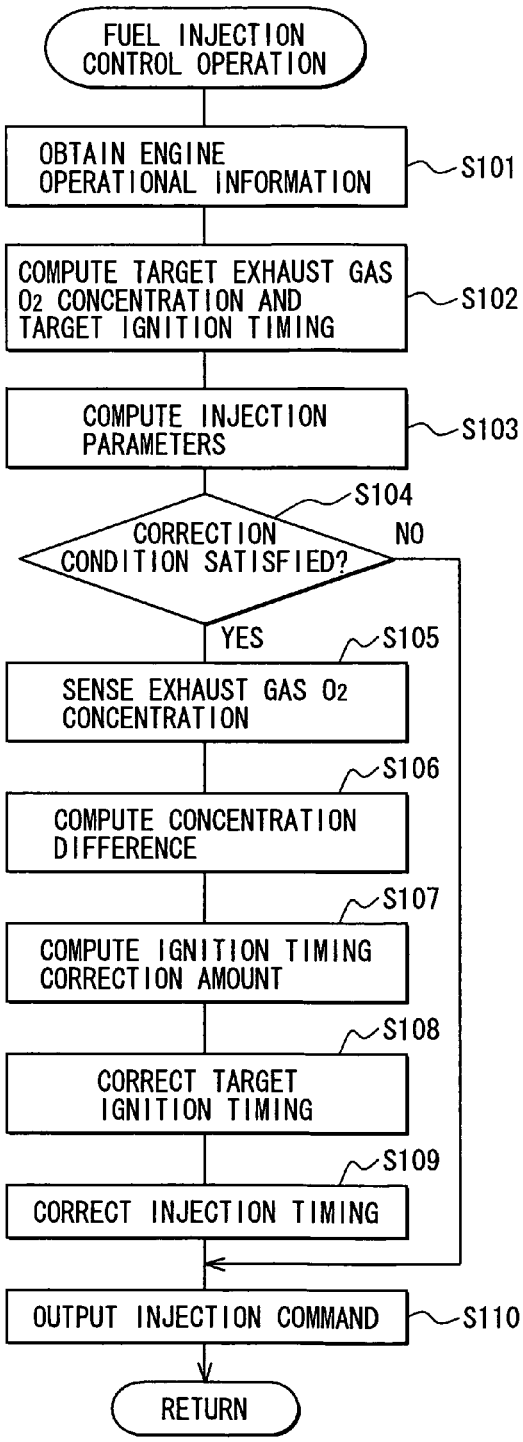
FIG. 4A is a flowchart showing an operational procedure of a fuel injection control operation according to the embodiment.
Figure 4B:
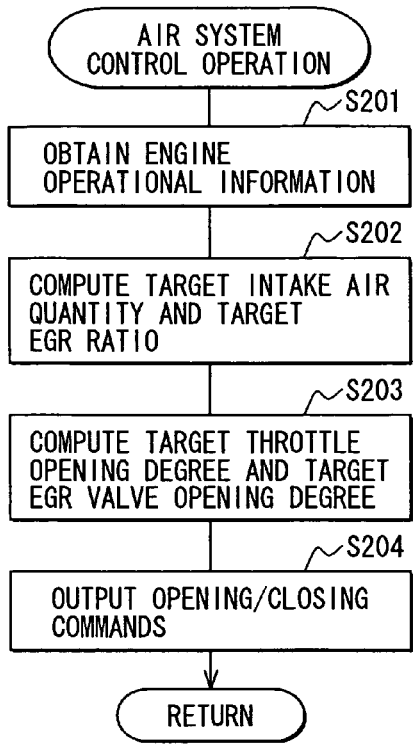
FIG. 4B is a flowchart showing an operational procedure of an air system control operation according to the embodiment.

FIGS. 4A and 4B show a control operation procedure of the fuel injection system and a control operation procedure of the air system. Specifically, FIG. 4A is a flowchart, which shows the operational procedure of the fuel injection control operation that serves as the control operation of the injection system, and FIG. 4B is a flowchart, which shows the operational procedure of the air system control operation for performing the opening/closing control operation of the throttle valve 12 and of the EGR valve 37. The fuel injection control operation and the air system control operation are executed by the ECU 60 at predetermined intervals.

First, in the fuel injection control operation of FIG. 4A, the fuel injection mode is adjusted based on the engine operational information. Furthermore, at the time of changing the combustion mode, the target ignition timing is corrected based on the exhaust gas oxygen concentration.

At step S101, the engine rotational speed and the accelerator operational amount (engine load) are obtained as the engine operational information. At step S102, the target exhaust gas oxygen concentration and the target ignition timing are computed based on the above engine operational information. At step S103, the injection parameter, such as the fuel injection start timing, is computed. Specifically, in the fuel injection control operation of the present embodiment, the fuel injection start timing is computed in a manner that reflects the difference between the target ignition timing and the actual ignition timing at the time of combustion. In this particular instance, the fuel injection start timing is computed based on the previous value of the difference between the target ignition timing and the actual ignition timing. Furthermore, at step S103, the fuel injection quantity and the fuel injection period are also computed as the injection parameters.

At step S104, it is determined whether the correction condition is satisfied, i.e., whether the combustion mode is changed. When it is determined that the correction condition is satisfied at step S104, the ECU 60 proceeds to step S105 to correct the target ignition timing. In contrast, when it is determined that the correction condition is not satisfied at step S104, the ECU 60 proceeds to step S110.

Specifically, when it is determined that the correction condition is satisfied at step S104, the ECU 60 proceeds to step S105 where the exhaust gas oxygen concentration is sensed with the air/fuel ratio sensor (the oxygen concentration sensor) 32. At step S106, a difference between the target exhaust gas oxygen concentration and the sensed exhaust gas oxygen concentration is computed. At step S107, a correction amount for correcting the target ignition timing is computed in response to the difference between the target exhaust gas oxygen concentration and the sensed exhaust gas oxygen concentration based on the constant torque characteristic data set for the exhaust gas oxygen concentration and the ignition timing. Then, at step S108, the target ignition timing is corrected based on the correction amount. At step S109, the fuel injection start timing is corrected based on the corrected target ignition timing. Thereafter, the ECU 60 proceeds to step S110.

At step S110, an injection command, which is determined based on the injection parameters that are computed based on the engine operational information, is outputted to the injector 15 when it is determined that the correction condition is not satisfied at step S104. Alternatively, the injection command, which is determined based on the injection parameters that are corrected based on the exhaust gas oxygen concentration, is outputted to the injector 15 in the case where it is determined that the correction condition is satisfied at step S104. Thereafter, the current fuel injection control operation is terminated.

Next, in the air system control operation shown in FIG. 4B, the throttle valve 12 and the EGR valve 37 are opened and closed based on the engine operational information.

At step S201, the engine rotational speed and the accelerator operational amount are obtained as the engine operational information. At step S202, a target intake air quantity and a target EGR ratio are computed based on the above engine operational information. At step S203, a target throttle opening degree and a target EGR valve opening degree are computed based on the target intake air quantity and the target EGR ratio. Then, at step S204, an opening/closing command, which corresponds to the target throttle opening degree, is outputted to the throttle actuator 13, and an opening/closing command, which corresponds to the target EGR valve opening degree, is outputted to the EGR actuator 38. Thereafter, the current air system control operation is terminated.

Figure 5A:
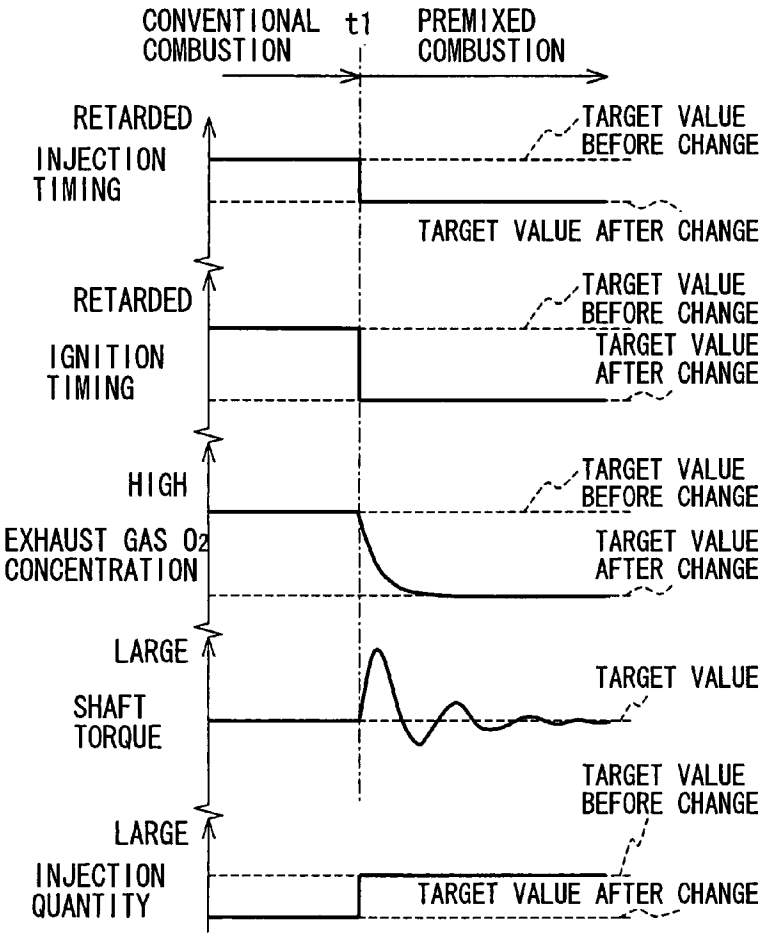
FIG. 5A RELATED ART
FIG. 5A is a diagram showing changes in fuel injection timing, ignition timing, an exhaust gas oxygen concentration, a shaft torque and an injection quantity with time in an exemplary case where the fuel injection control operation of FIG. 4A is not applied.
Figure 5B:
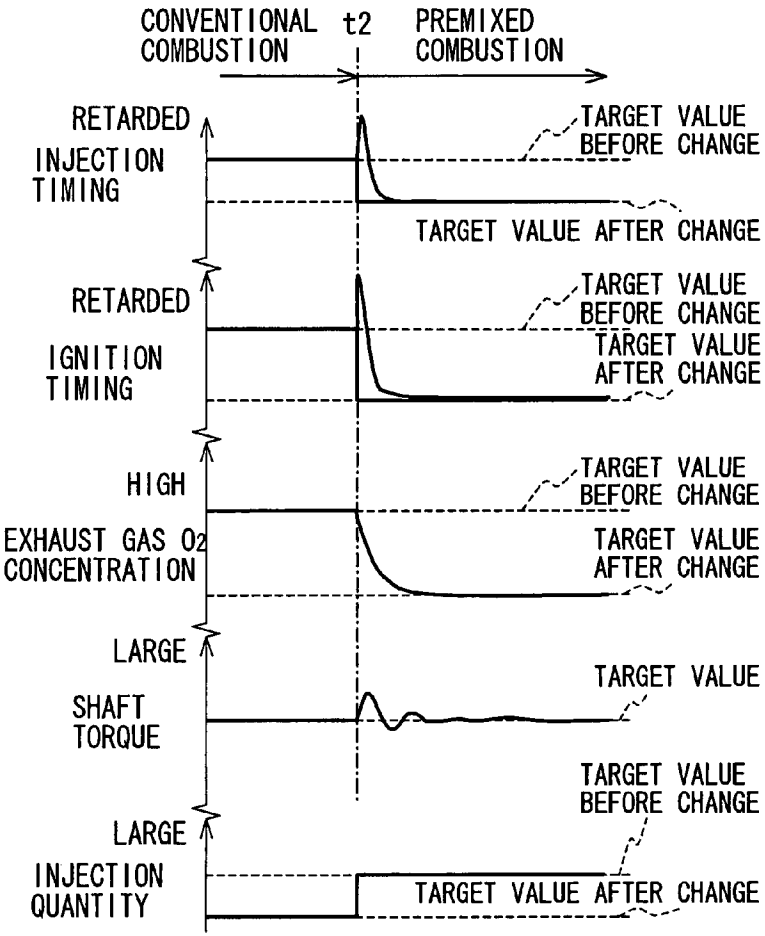
FIG. 5B is a diagram similar to FIG. 5A but showing a case where the fuel injection control operation of FIG. 4A is applied.
Figure 6A:
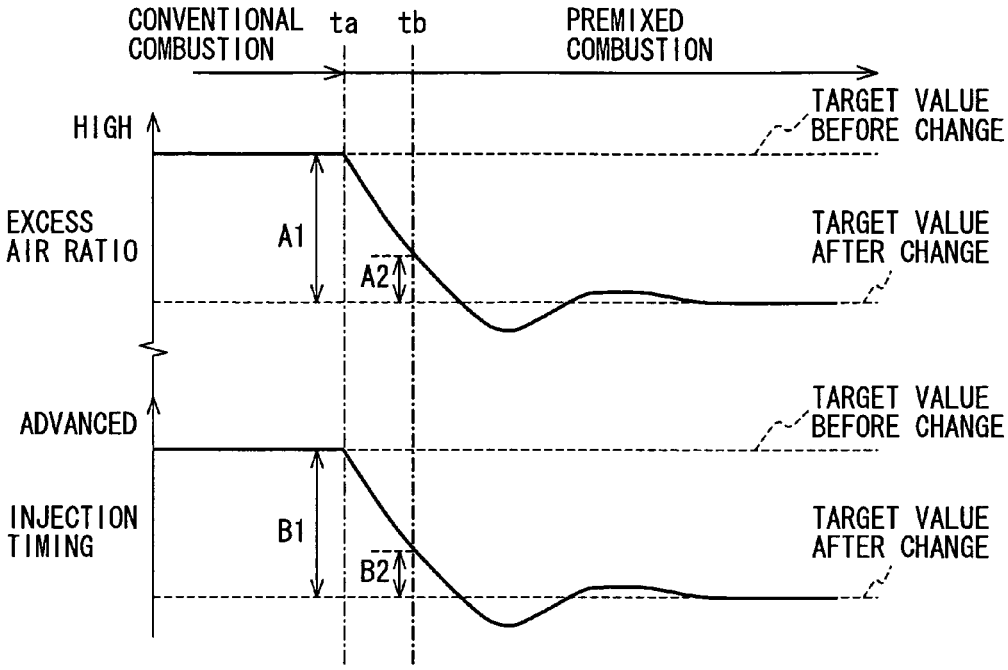
FIG. 6A RELATED ART
FIGS. 6A and 6B are diagrams showing a way of correcting fuel injection timing according to a previously proposed technique.
Figure 6B:
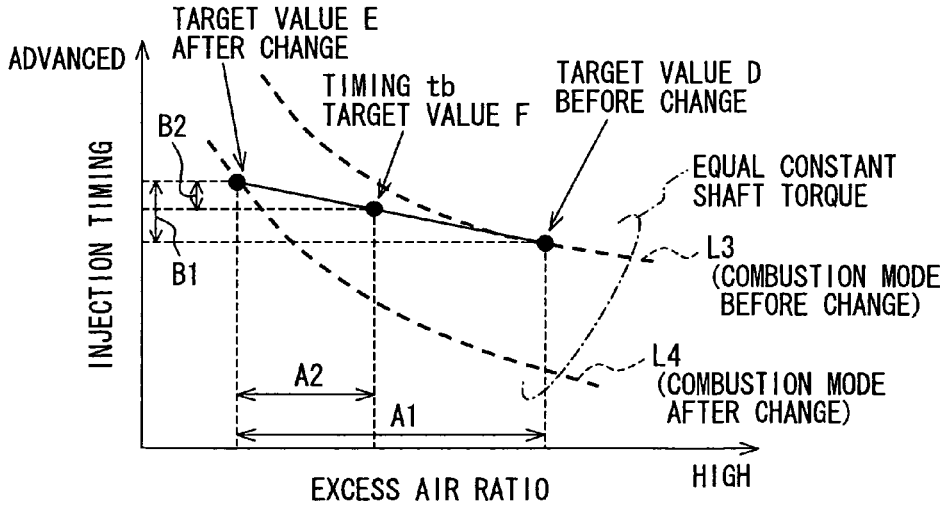
FIG. 6B RELATED ART

FIGS. 5A and 5B show changes in the ignition timing, the exhaust gas oxygen concentration and others at the time of changing the combustion mode. Specifically, FIG. 5A shows the changes in the case where the fuel injection control operation of FIG. 4A is not applied, and FIG. 5B shows the changes in the case where the fuel injection control operation of FIG. 4A is applied. In the case of FIG. 5A, the combustion mode is changed from the normal (conventional) combustion to the semi-premixed combustion at the timing t1. Also, in FIG. 5B, the combustion mode is changed from the normal (conventional) combustion to the semi-premixed combustion at the timing t2.

In the case of FIG. 5A where the fuel injection control operation of FIG. 4A is not applied, when the combustion mode is changed at the timing t1, the fuel injection start timing is instantaneously changed in response to the change in the target ignition timing, and the exhaust gas oxygen concentration gradually approaches to the changed target value that is set for after the change. The ignition timing is rapidly changed right after the timing t1, so that the shaft torque largely changes.

In contrast, in FIG. 5B where the fuel injection control operation of FIG. 4A is applied, when the combustion mode is changed at the timing t2, the target ignition timing is corrected according to the actual value of the exhaust gas oxygen concentration, and the fuel injection start timing is adjusted according to the corrected target ignition timing. In this way, the change in the shaft torque can be made relatively small.

According to the present embodiment, the following advantages can be achieved.

The relationship between the exhaust gas oxygen concentration and the ignition timing for achieving the generally equal constant shaft torque is predefined as the characteristic curve (e.g., L1, L2 in FIG. 3). The target ignition timing is corrected according to the measured exhaust gas oxygen concentration in view of the characteristic curve, so that the delayed change in the air system, which conducts the intake air and the EGR gas, is reflected into the fuel injection system. Therefore, the balance between the air system and the fuel injection system is maintained, and it is possible to avoid occurrence of the unintentional combustion state. In this way, the change in the shaft torque can be limited, and the good drivability of the vehicle can be maintained.

Furthermore, the characteristic curve is set for each combustion mode. When the combustion mode is changed, the target ignition timing is corrected based on the corresponding characteristic curve, which is set for the current combustion mode after the change. Thus, at the time of changing the combustion mode, at which the air system as well as the target values of the adjustment parameters of the air system are likely to change, it is possible to avoid occurrence of the unintentional combustion state.

Furthermore, the combustion pressure sensor 51 is provided to the engine 10, and the injection parameters are adjusted in such a manner that the sensed ignition timing coincides with the target ignition timing. In this way, the actual ignition timing is kept to coincide with the target ignition timing, and the deterioration of the combustion state is avoided.

The present invention is not limited to the above embodiment. For example, the above embodiment may be modified in the following manner.

In the above embodiment, the target ignition timing is corrected according to the sensed exhaust gas oxygen concentration, which is sensed with the air/fuel ratio sensor 32. However, the present invention is not limited to this. For example, a pressure sensor 100 may be connected to the ECU 60, as shown in FIG. 1. The pressure sensor 100 may be provided in the intake air pipe 11 or the exhaust pipe 31. The target ignition timing may be corrected based on a measurement value of this pressure sensor 100 and the exhaust gas oxygen concentration, which is sensed with the air/fuel ratio sensor 32. The ignition timing for achieving the generally equal constant torque is also influenced by the pressure information (e.g., the intake air pressure and the exhaust gas pressure) besides the oxygen information of the exhaust gas. Thus, the target ignition timing may be corrected based on the intake air pressure or the exhaust gas pressure besides the exhaust gas oxygen concentration to more effectively avoid the deterioration of the combustion state and thereby to maintain the good drivability of the vehicle.

In the above embodiment, the target ignition timing is corrected according to the exhaust gas oxygen concentration at the time of changing the combustion mode. However, the present invention is not limited to this. For example, the target ignition timing may be corrected based on the exhaust gas oxygen concentration when the engine operational state is changed in the same combustion mode to cause a change in the target value of the intake air quantity and a change in the target value of the circulation quantity of the EGR gas. In this way, it is possible to avoid the occurrence of the unintentional combustion state, which is caused by the delayed change in the air system.

Furthermore, although the semi-premixed combustion and the premixed combustion are used as the combustion modes, the present invention is not limited to this. For example, the present invention is equally applicable to any other suitable case where the characteristic curves shown in FIG. 3 change before and after a change in the combustion, such as a case where the combustion is changed from lean combustion to rich combustion at the time of deoxidizing an NOx catalyst.

In the above embodiment, the exhaust gas oxygen concentration is directly sensed with the air/fuel ratio sensor (the oxygen concentration sensor) 32. However, the present invention is not limited to this. For example, at least one of an air flow meter, which senses an intake air quantity, and an intake air pressure sensor, which senses an intake air pressure, may be provided in the intake air pipe 11. A filled air quantity in the cylinder may be computed based on the sensed intake air quantity or the sensed intake air pressure. Then, the exhaust gas oxygen concentration may be estimated based on the filled air quantity in the cylinder and the injected fuel quantity, which is injected from the injector 15. Thereafter, the target ignition timing may be corrected based on the estimated exhaust gas oxygen concentration to avoid the occurrence of the unintentional combustion state.

In the above embodiment, the injection start timing is corrected to adjust the ignition timing. In addition to or alternative to this, the fuel injection period and/or an injection rate may be corrected as injection parameters. The ignition timing can be adjusted by correcting these parameters.

Additional advantages and modifications will readily occur to those skilled in the art. The invention in its broader terms is therefore not limited to the specific details, representative apparatus, and illustrative examples shown and described.

What is claimed is:

1. A control system for a compression ignition internal combustion engine that has a fuel injection valve, which injects fuel into a corresponding cylinder of the engine, the control system comprising:

a control means for determining target ignition timing based on operational information of the engine and for adjusting a fuel injection mode at the fuel injection valve according to the target ignition timing;

an oxygen information obtaining means for obtaining oxygen information of exhaust gas, which is exhausted from the cylinder of the engine; and a correcting means for correcting the target ignition timing based on the oxygen information, which is obtained by the oxygen information obtaining means, with reference to predefined constant torque characteristic data, which indicates a relationship between the oxygen information and ignition timing for achieving a generally equal constant torque.

2. The control system according to claim 1, wherein:

the oxygen information obtaining mean includes an oxygen concentration sensor, which senses an oxygen concentration of the exhaust gas as the oxygen information; and the correcting means corrects the target ignition timing based on the oxygen concentration of the exhaust gas, which is sensed with the oxygen concentration sensor.

3. The control system according to claim 1, wherein:

the constant torque characteristic data is preset for each of a plurality of combustion modes, each of which is preset according to an operational state of the engine; and when a combustion mode of the engine is changed from one of the plurality of combustion modes to another one of the plurality of combustion modes, the correcting means corrects the target ignition timing based on the corresponding constant torque characteristic data, which is preset for the another one of the plurality of combustion modes.

4. The control system according to claim 3, wherein the plurality of combustion modes includes a premixed combustion and a conventional combustion.

5. The control system according to claim 1, further comprising a pressure sensor, which senses one of an intake air pressure and an exhaust gas pressure, wherein the correcting means corrects the target ignition timing based on the one of the intake air pressure and the exhaust gas pressure, which is sensed with the pressure sensor, in addition to the oxygen information.

6. The control system according to claim 1, further comprising an ignition timing sensor that senses ignition timing of the cylinder, wherein the control means adjusts the fuel injection mode at the fuel injection valve in such a manner that the sensed ignition timing, which is sensed with the ignition timing sensor, coincides with the target ignition timing.

* * * * *